US011885524B2

(12) United States Patent
Mislak et al.

(10) Patent No.: US 11,885,524 B2
(45) Date of Patent: Jan. 30, 2024

(54) HVAC SYSTEM USING REHEAT FROM ALTERNATIVE HEAT SOURCE

(71) Applicant: Johnson Controls Technology Company, Auburn Hills, MI (US)

(72) Inventors: Nicholas P. Mislak, Bel Air, MD (US); Ryan L. Snider, York, PA (US); Karla D. Alvarez Cavazos, York, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 388 days.

(21) Appl. No.: 17/069,681

(22) Filed: Oct. 13, 2020

(65) Prior Publication Data

US 2021/0116136 A1 Apr. 22, 2021

Related U.S. Application Data

(60) Provisional application No. 62/916,675, filed on Oct. 17, 2019.

(51) Int. Cl.

| | |
|---|---|
| ***F24F 3/052*** | (2006.01) |
| ***F24F 11/86*** | (2018.01) |
| ***F24F 11/85*** | (2018.01) |

(52) U.S. Cl.

CPC ..... *F24F 3/0525* (2013.01); *F24F 11/85* (2018.01); *F24F 11/86* (2018.01)

(58) Field of Classification Search

CPC ..... F24F 3/0525; F24F 11/85; F24F 11/86; F24F 3/153; F24F 5/001; F24F 12/00

See application file for complete search history.

(56) References Cited

U.S. PATENT DOCUMENTS

| | | | | |
|---|---|---|---|---|
| 6,427,461 | B1 | 8/2002 | Whinery et al. | |
| 6,644,049 | B2 | 11/2003 | Alford | |
| 6,705,093 | B1 * | 3/2004 | Taras | F24F 3/153 62/90 |
| 7,165,414 | B2 | 1/2007 | Wright | |
| 9,772,124 | B2 | 9/2017 | Wintemute et al. | |
| 10,022,646 | B1 | 7/2018 | Almotlaq et al. | |
| 10,161,662 | B2 | 12/2018 | Goel et al. | |
| 10,309,685 | B2 | 6/2019 | Street et al. | |
| 10,337,755 | B2 | 7/2019 | Goel et al. | |
| 2006/0218949 | A1 * | 10/2006 | Ellis | F24F 3/153 62/173 |
| 2009/0173096 | A1 | 7/2009 | Wohlert | |
| 2012/0168119 | A1 | 7/2012 | Dunnavant | |
| 2017/0059187 | A1 | 3/2017 | Smith, Jr. | |
| 2018/0363947 | A1 | 12/2018 | Cosby, II et al. | |

FOREIGN PATENT DOCUMENTS

| | | | | |
|---|---|---|---|---|
| CN | 103019185 A | * | 4/2013 | |
| CN | 206846891 U | | 1/2018 | |
| EP | 2327575 A1 | * | 6/2011 | B60H 1/00278 |

(Continued)

*Primary Examiner* — Emmanuel E Duke
(74) *Attorney, Agent, or Firm* — Fletcher Yoder, P.C.

(57) ABSTRACT

A heating, ventilation, and/or air conditioning (HVAC) system includes a refrigerant circuit configured to circulate a refrigerant to condition an air flow within an air flow conduit and a reheat system fluidly separate from the refrigerant circuit, wherein the reheat system is configured to utilize a waste fluid from a waste heat source to reheat the air flow conditioned by the refrigerant circuit.

6 Claims, 12 Drawing Sheets

(56) References Cited

FOREIGN PATENT DOCUMENTS

| | | | | | |
|---|---|---|---|---|---|
| EP | 2963353 | A1 | | 1/2016 | |
| JP | 11294832 | A | | 10/1999 | |
| JP | 11311438 | A | | 11/1999 | |
| KR | 101203574 | B1 | | 11/2012 | |
| KR | 2016037028 | A | * | 4/2016 | |
| WO | 2013113267 | A1 | | 8/2013 | |
| WO | WO-2017138820 | A1 | * | 8/2017 | ..... F24F 3/153 |

* cited by examiner

HVAC SYSTEM USING REHEAT FROM ALTERNATIVE HEAT SOURCE

CROSS REFERENCE TO RELATED APPLICATION

This application claims priority from and the benefit of U.S. Provisional Application Ser. No. 62/916,675, entitled "HVAC SYSTEM USING REHEAT FROM ALTERNATIVE HEAT SOURCE," filed Oct. 17, 2019, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of an air flow delivered to the environment. For example, the HVAC system may circulate a refrigerant and place the refrigerant in a heat exchange relationship with a supply air flow to condition the supply air flow before the supply air flow is discharged to the conditioned environment. For example, refrigerant may be circulated through an evaporator of a refrigerant circuit in order to cool the supply air flow. In some embodiments, the refrigerant circuit may include a reheat heat exchanger in addition to the evaporator, and the reheat heat exchanger may circulate the refrigerant to reheat the supply air flow in order to control a moisture content of the supply air flow and achieve a target humidity of the supply air flow. However, it may be difficult to circulate the refrigerant through the evaporator and through the reheat heat exchanger of the refrigerant circuit to achieve a desired temperature and humidity of the supply air flow.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a refrigerant circuit configured to circulate a refrigerant to condition an air flow within an air flow conduit and a reheat system fluidly separate from the refrigerant circuit, wherein the reheat system is configured to utilize a waste fluid from a waste heat source to reheat the air flow conditioned by the refrigerant circuit.

In one embodiment, a heating, ventilation, and/or air conditioning (HVAC) system includes a refrigerant circuit configured to circulate a refrigerant to condition an air flow within an air flow conduit, a reheat heat exchanger fluidly separate from the refrigerant circuit and configured to place a waste fluid in a heat exchange relationship with the air flow to reheat the air flow conditioned by the refrigerant circuit, and a reservoir fluidly coupled to the reheat heat exchanger and configured to store the waste fluid for supply to the reheat heat exchanger.

In one embodiment, a heating, ventilation, and/or air conditioning (HVAC) system includes a first refrigerant circuit configured to circulate a first refrigerant and having an evaporator configured to place the first refrigerant in a first heat exchange relationship with an air flow to condition the air flow, a second refrigerant circuit configured to circulate a second refrigerant having a reheat heat exchanger configured to place the second refrigerant in a second heat exchange relationship with the air flow, and an intermediate conduit fluidly coupling the first refrigerant circuit and the second refrigerant circuit with one another. The intermediate conduit is configured to enable transfer of the first refrigerant, the second refrigerant, or both, between the first refrigerant circuit and the second refrigerant circuit.

DRAWINGS

Various aspects of this disclosure may be better understood upon reading the following detailed description and upon reference to the drawings in which.

Figure 11:
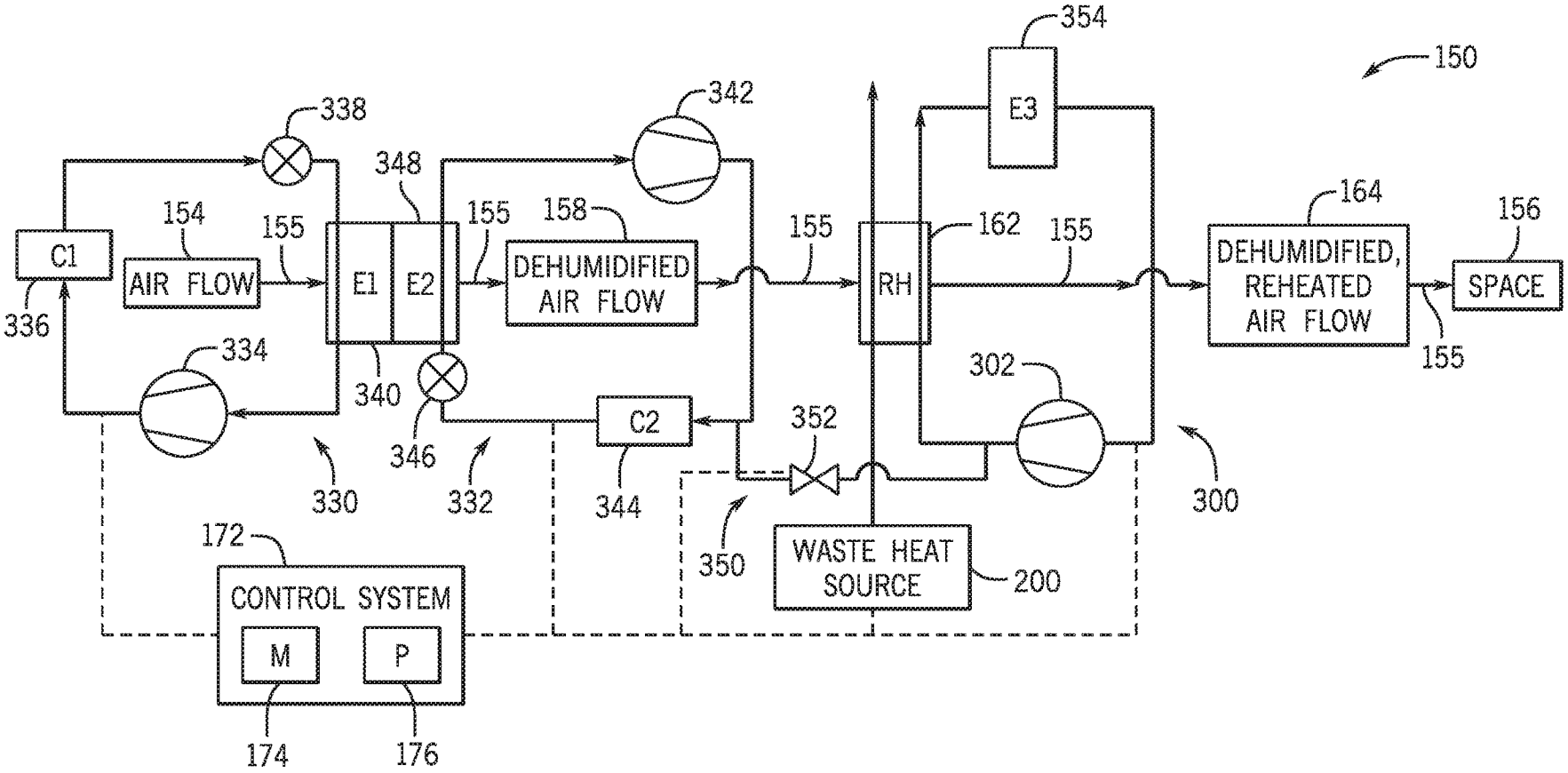
Figure 12:
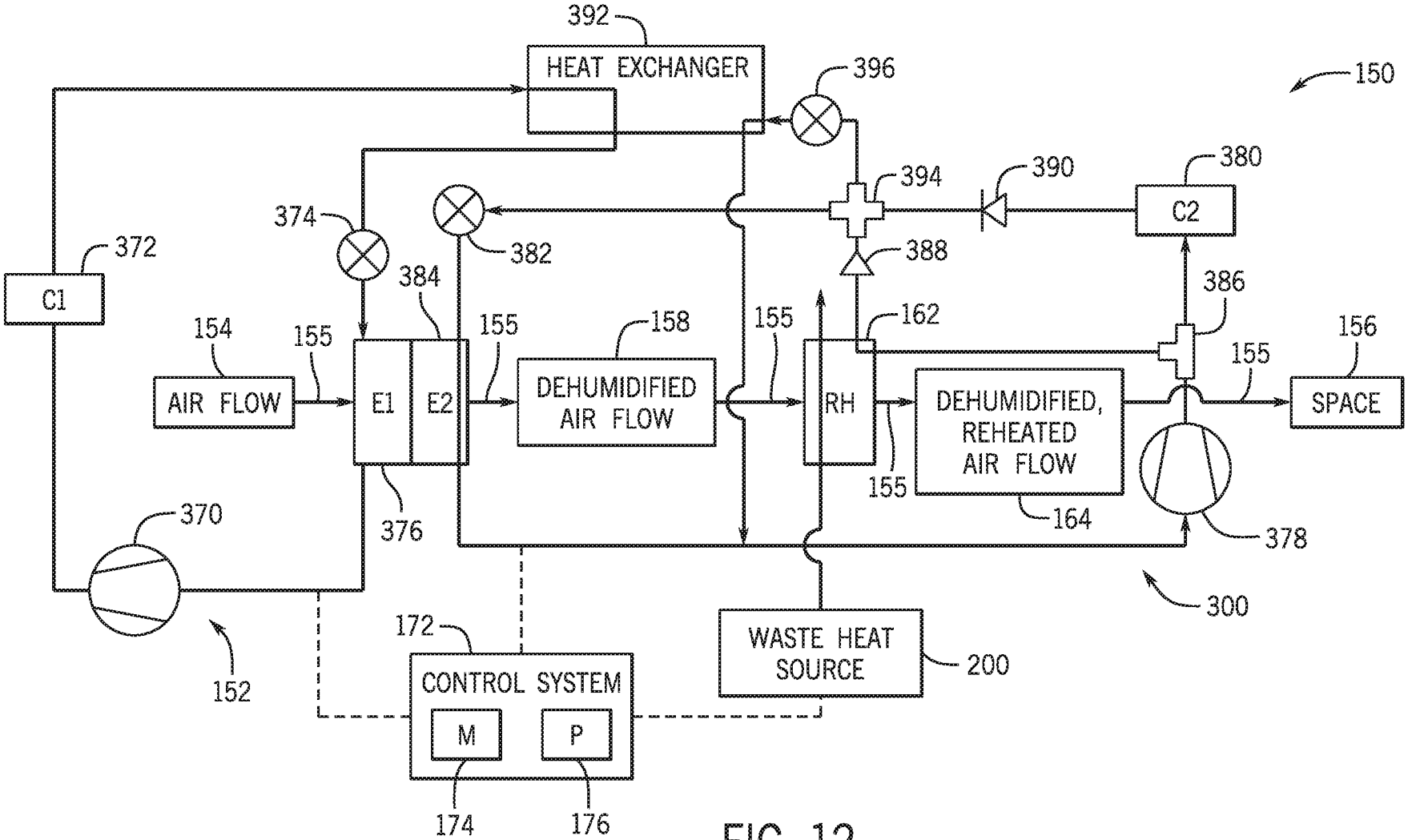

FIG. 11 is an embodiment of an HVAC system having a first refrigerant circuit, a second refrigerant circuit, and a reheat fluid circuit, in accordance with an aspect of the present disclosure; and FIG. 12 is a schematic of an embodiment of an HVAC system having a reheat fluid circuit configured to provide reheating and/or cooling via a refrigerant, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system configured to condition an air flow and to supply the conditioned air flow to a structure or building. For example, the HVAC system may be configured to cool the air flow so as to condense and remove moisture contained within the air flow, thereby dehumidifying the air flow. However, dehumidifying the air flow may reduce a temperature of the air flow below a comfortable or desirable level. For this reason, the HVAC system may reheat the cooled air flow to a comfortable or desirable level and then deliver the reheated air flow to a space conditioned by the HVAC system. As an example, the HVAC system may include a reheat heat exchanger having heating capabilities. The cooled air flow may be directed across the reheat heat exchanger to absorb heat provided by the reheat heat exchanger in order to reheat the cooled air flow.

In some embodiments, the HVAC system may include a refrigerant circuit through which a refrigerant is circulated. The refrigerant circuit may include a heat exchanger, such as an evaporator, configured to place cooled refrigerant in a first heat exchange relationship with the air flow to cool the air flow. The refrigerant circuit may also include the reheat heat exchanger configured to place heated refrigerant in a second heat exchange relationship with the air flow to reheat the air flow. In other words, a portion of the refrigerant in the refrigerant circuit may be used to cool the air flow and another portion of the same refrigerant may be used to reheat the air flow. To this end, the refrigerant circuit may include components configured to control the amounts of refrigerant flowing through the evaporator and the reheat heat exchanger to adjust the temperature of the air flow at various sections of the refrigerant circuit.

However, incorporating the reheat heat exchanger into the refrigerant circuit to heat an air flow with the same refrigerant that is used to cool the air flow may increase a complexity and/or cost of manufacture and/or operation of the HVAC system. For example, additional features or components, such as conduits and valves, may be incorporated in the refrigerant circuit to enable reheating capabilities of the HVAC system via the reheat heat exchanger. Such components may be designed and controlled so as to direct the refrigerant in a desirable manner through the refrigerant circuit to regulate an amount of cooling provided by the evaporator and/or an amount of reheating provided by the reheat heat exchanger. Additionally or alternatively, it may be difficult to control conditioning of the air flow accurately or acutely. For example, the cooling and/or reheating of the air flow may be limited based on an amount of refrigerant directed to the evaporator or the reheat heat exchanger, respectively, and/or based on a total amount of refrigerant in the HVAC system. Thus, cooling and/or reheating capabilities may be limited by the amount of refrigerant circulating through the HVAC system, and a target cooling and/or reheating amount may not be efficiently achieved.

As such, it is now recognized that using a fluid that is separate from the refrigerant in the refrigerant circuit for reheat purposes may improve conditioning capabilities of the HVAC system. In other words, the refrigerant of the refrigerant circuit may be used to cool the air flow, and a different fluid may be used to reheat the air flow. Accordingly, embodiments of the present disclosure are directed to a reheat system that is fluidly separate from the refrigerant circuit. In some implementations, the reheat system may extract waste heat from a waste heat source, such as heat generated from an industrial process or operation, to reheat the air flow. The amount of heat extracted from the waste heat source may be acutely controlled so as to reheat the air flow by a target amount. Utilization of waste heat sources may also improve efficient operation of the HVAC system.

Additionally or alternatively, the reheat system may include an additional refrigerant circuit that is separate from the refrigerant circuit and is configured to circulate an additional refrigerant for reheating purposes. The refrigerant circuit and the additional refrigerant circuit may be independently controllable. Thus, the amount of cooling provided by the refrigerant circuit may be set independently from the amount of reheating provided by the additional refrigerant circuit. In any case, utilizing a reheat system that is fluidly separate from the refrigerant circuit may enable more acute control when conditioning the air flow, thereby improving performance of the HVAC system to condition the air flow.

Figure 1:
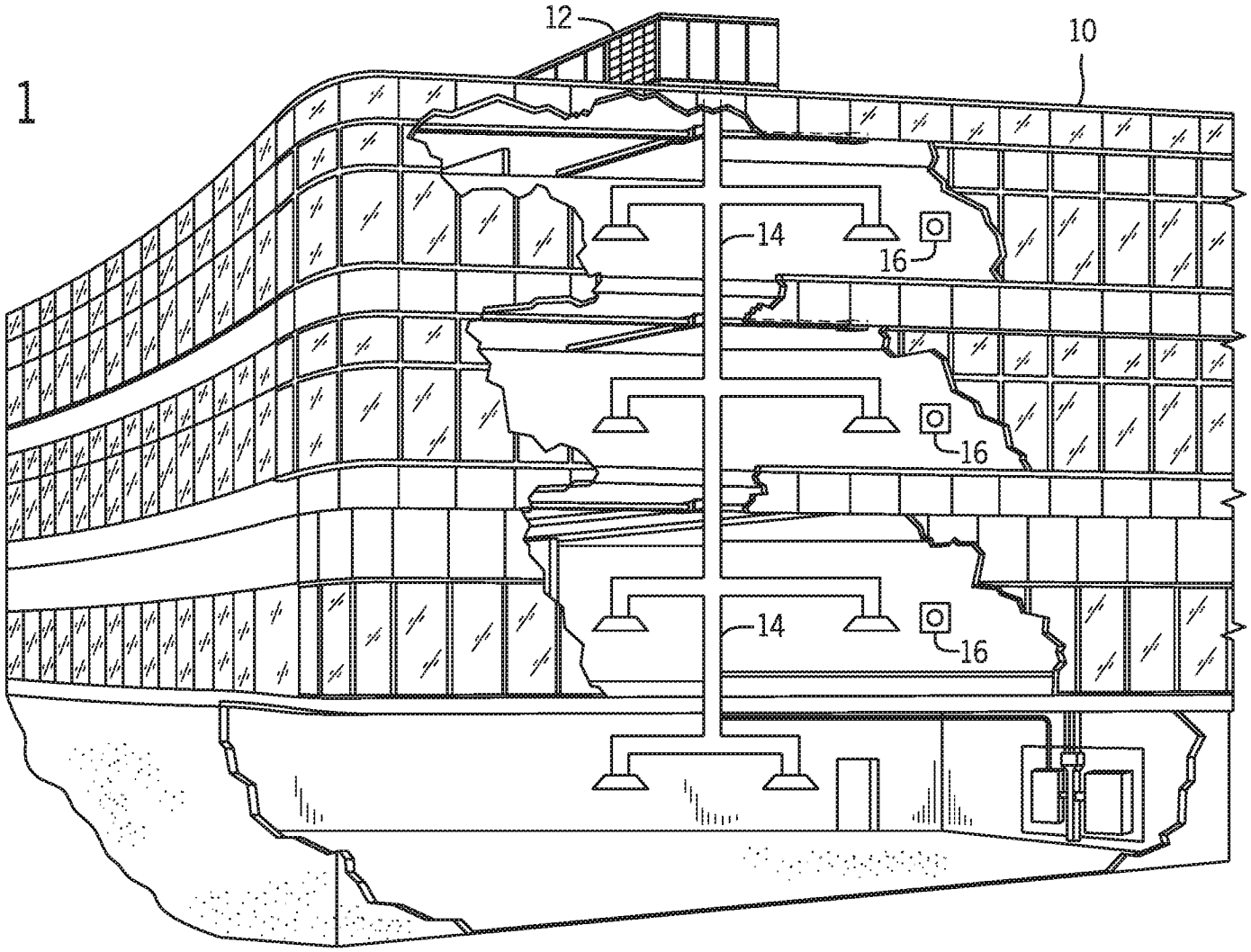
FIG. 1 is a perspective view of an embodiment of a heating, ventilation, and/or air conditioning (HVAC) system for environmental management that may employ one or more HVAC units, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
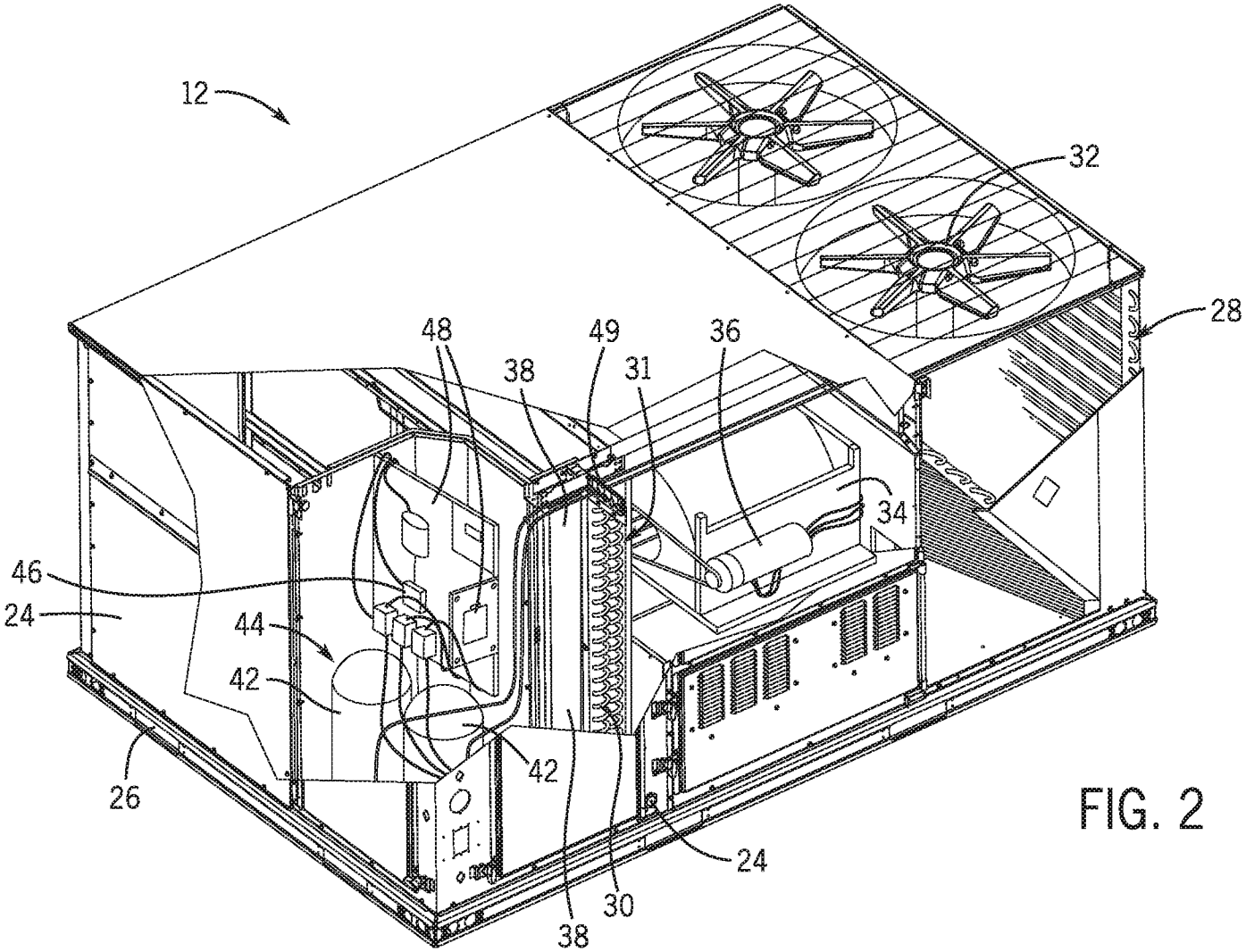
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be noted, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
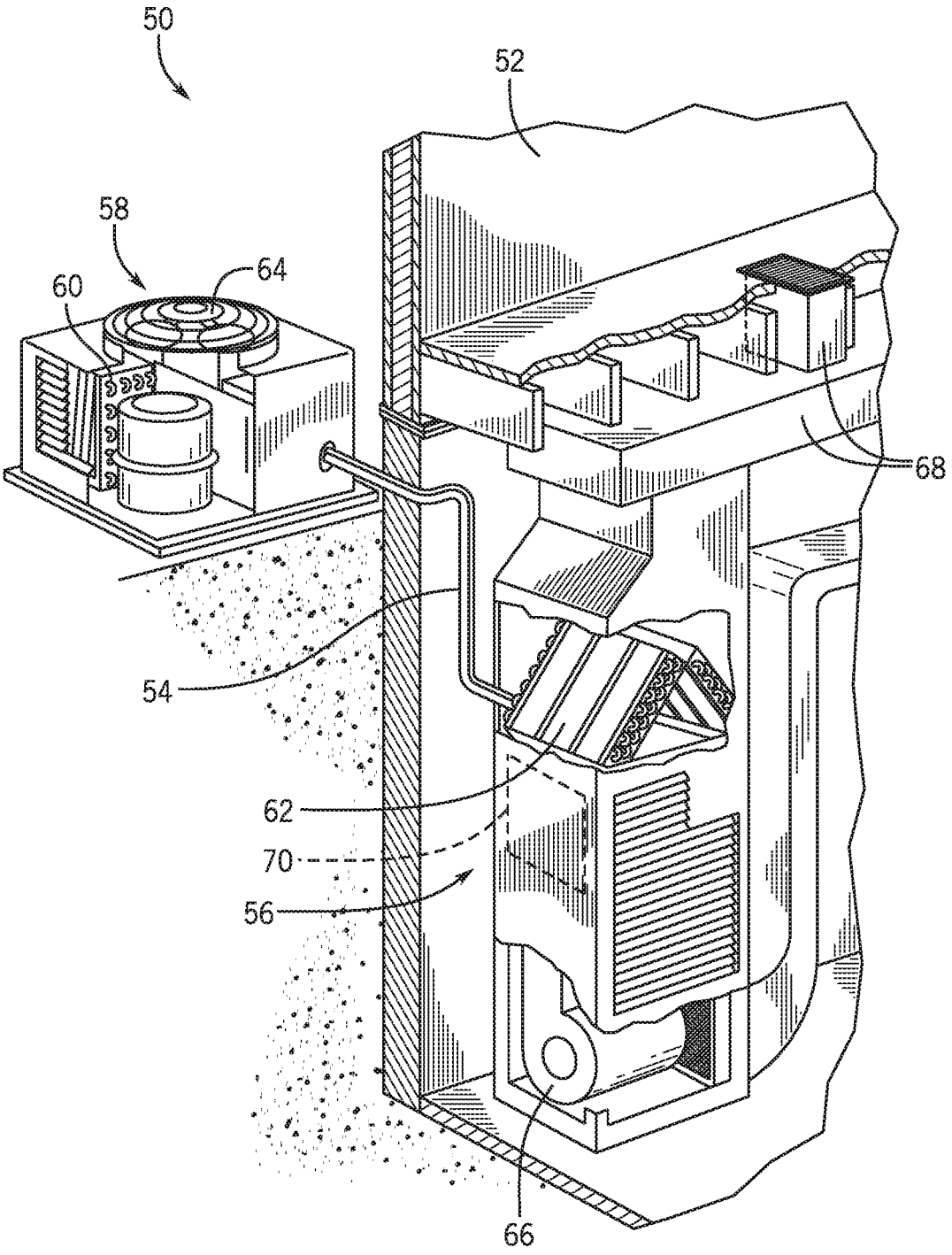
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
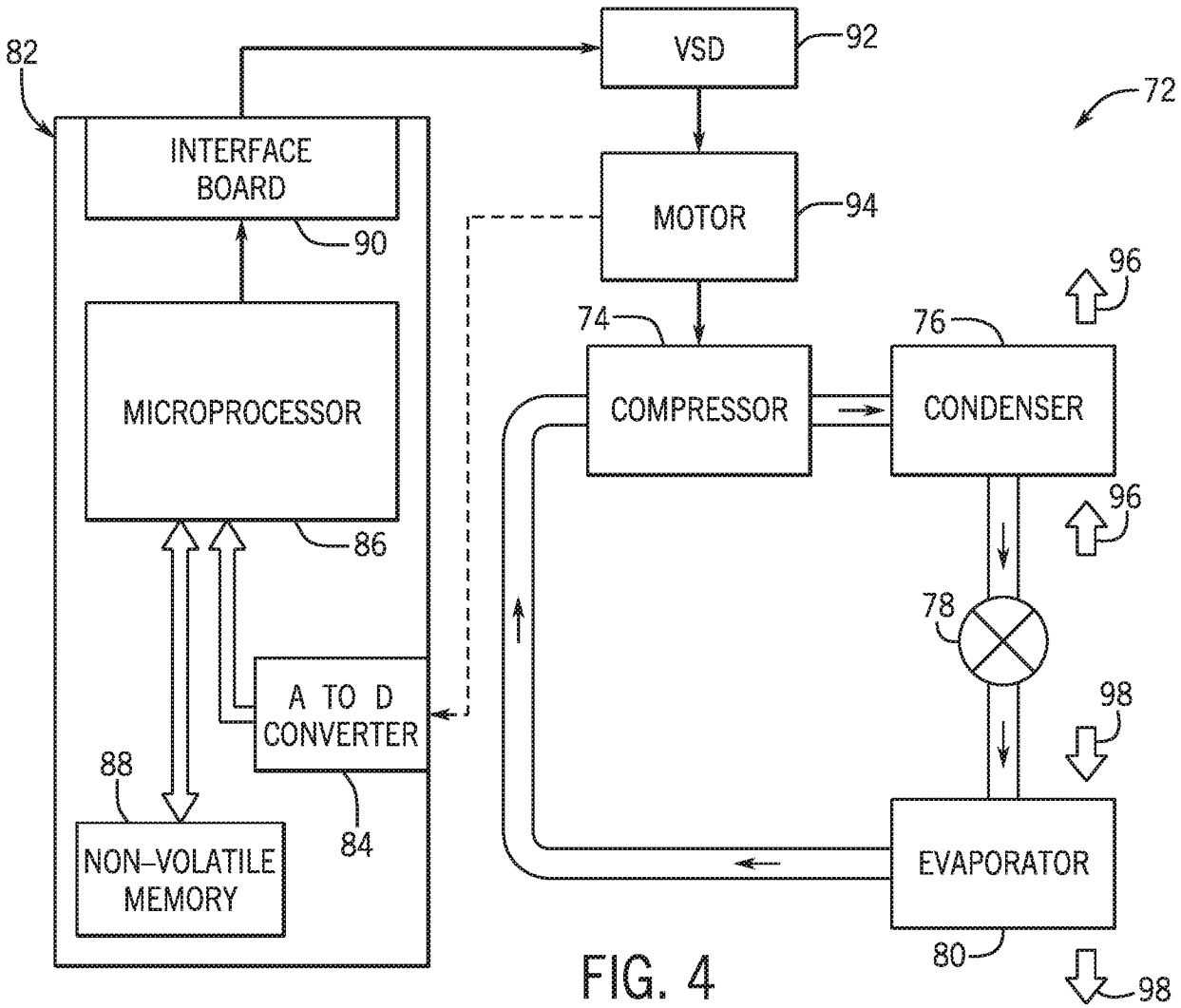
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be noted that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system, such as the HVAC unit 12 of FIG. 2, may utilize a reheat system to enable dehumidification of an air flow conditioned by the HVAC system. For example, the reheat system may include a reheat heat exchanger configured to place the air flow in a heat exchange relationship with a heated fluid to enable heat transfer from the heated fluid to the air flow, thereby heating the air flow. The reheat system may be fluidly separate from a refrigerant circuit, which is configured to circulate a refrigerant to place the air flow in an additional heat exchange relationship with the refrigerant to enable heat transfer from the air flow to the refrigerant, thereby cooling the air flow. That is, the refrigerant directed through the refrigerant circuit (e.g., to cool the air flow) may not flow through the reheat system, and the heated fluid directed through the reheat system (e.g., to reheat the air flow) may not flow through the refrigerant circuit. In some embodiments, the reheat system may use heat extracted from a waste heat source, such as an industrial process system. In additional or alternative embodiments, the reheat system may include another, separate refrigerant circuit configured to circulate an additional refrigerant, and the reheat system may heat the additional refrigerant and use the heated additional refrigerant to reheat the air flow. In general, the reheat system may be controlled independently from components of the refrigerant circuit such that cooling provided by the refrigerant circuit is independent of reheating provided by the reheat system. As such, the HVAC system may control cooling and/or reheating of the air flow more acutely, thereby improving the conditioning of the air flow.

Figure 5:
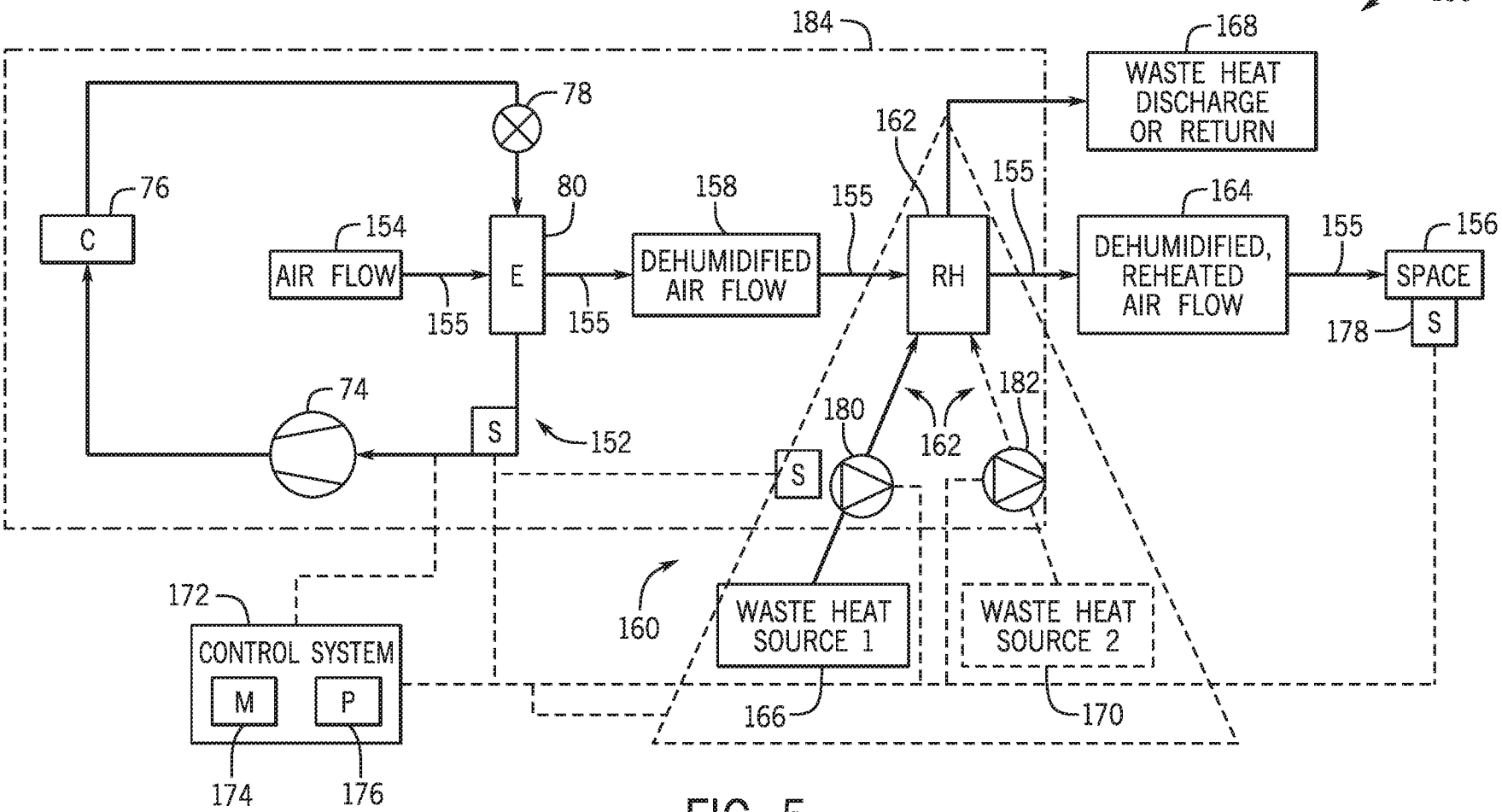
FIG. 5 is a schematic of an embodiment of an HVAC system having a reheat system configured to reheat an air flow via heat from a waste heat source, in accordance with an aspect of the present disclosure.

With this in mind, FIG. 5 is a schematic of an embodiment of an HVAC system 150 having reheat capabilities. In some embodiments, the HVAC system 150 may be implemented with the building 10 of FIG. 1 to condition, such as to cool and/or to reheat, an air flow and to supply the conditioned air flow throughout the building 10. As an example, the HVAC system 150 may be an embodiment of the HVAC unit 12 incorporating the reheat features discussed herein, and the HVAC system 150 may include similar features and components described above with reference to FIG. 2 and FIG. 4. For example, the HVAC system 150 may include a refrigerant circuit 152, which may be similar to the vapor compression system 72, configured to circulate a refrigerant. The refrigerant circuit 152 may include the compressor 74, the condenser 76, the expansion device 78, and/or the evaporator 80 as described above. The refrigerant circuit 152 may also include various components, such as conduits, valves, pumps, and so forth, to circulate the refrigerant through different sections and components of the refrigerant circuit 152. An air flow 154, which may include ambient air from an ambient environment and/or return air from a space 156 conditioned by the HVAC system 150, such as a space within the building 10 of FIG. 1, may be directed across the evaporator 80 via an air flow conduit 155 to exchange heat with the refrigerant flowing through coils of the evaporator 80. For example, the air flow conduit 155 may include a blower or a fan configured to direct the air flow 154 through the HVAC system 150 and across the evaporator 80. The refrigerant within the evaporator 80 may absorb heat from the air flow 154, thereby cooling the air flow 154 and condensing moisture contained within the air flow 154. The condensed moisture may then be removed from the air flow 154 within the evaporator 80, and the air flow 154 exiting the evaporator 80 may be a dehumidified air flow 158.

In some circumstances, the evaporator 80 may reduce the temperature of the air flow 154 below a comfortable or desirable level in order to remove a target amount of moisture from the air flow 154. Thus, it may be desirable to reheat the dehumidified air flow 158 to a comfortable or desirable temperature. To this end, the HVAC system 150 may also include a reheat system 160 configured to reheat the dehumidified air flow 158. The reheat system 160 may include a reheat fluid circuit 161 configured to circulate a reheat fluid, and the reheat fluid circuit 161 may be fluidly separate from the refrigerant circuit 152. In certain embodiments, the reheat system 160 may include a reheat heat exchanger 162 positioned downstream of the evaporator 80 relative to a flow direction of the air flow 154 through the air flow conduit 155. The air flow conduit 155 may direct the dehumidified air flow 158 to the reheat heat exchanger 162, and the reheat heat exchanger 162 may be configured to place the reheat fluid in a heat exchange relationship with the dehumidified air flow 158 to transfer heat from the reheat fluid to the dehumidified air flow 158, thereby heating the dehumidified air flow 158 to a dehumidified, reheated air flow 164. The dehumidified, reheated air flow 164 may then be delivered to the space 156 to condition the space 156.

As mentioned above, the reheat system 160 may be fluidly separate from the refrigerant circuit 152. In other words, the refrigerant of the refrigerant circuit 152 does not flow through the reheat system 160 (e.g., the reheat fluid circuit 161), and the reheat fluid of the reheat system 160 does not flow through the refrigerant circuit 152. Accordingly, the refrigerant circuit 152 may be controlled independently from the reheat system 160, and the amount of cooling provided by the evaporator 80 may be controlled independently from the amount of reheating provided by the reheat heat exchanger 162. In this manner, a target condition of the air flow 154, including a humidity and/or a temperature, may be better and/or more efficiently achieved.

In the illustrated embodiment, the reheat system 160 may extract thermal energy or heat from a waste heat source, such as a first waste heat source 166. As used herein, a waste heat source refers to any system, process, component, or other feature that produces waste heat as a byproduct. For instance, the first waste heat source 166 may be an industrial process or system. In some embodiments, the reheat fluid may be a heated waste fluid received from the first waste heat source 166, and the reheat heat exchanger 162 directly receives the heated waste fluid. As an example, the heated waste fluid may be a heated liquid, such as water, oil, refrigerant, another suitable liquid, or any combination thereof, produced as a byproduct of the industrial process. The heated waste fluid may be directed through the reheat heat exchanger 162, which enables heat to transfer from the heated waste fluid to the dehumidified air flow 158 to produce the dehumidified, reheated air flow 164. The waste fluid may then be directed from the reheat heat exchanger 162 to a waste heat discharge or return 168. The waste heat discharge or return 168 may remove the waste fluid from the HVAC system 150, such as for disposal of the waste fluid and/or for returning the waste fluid back to the first waste heat source 166 to be reused (e.g., in the same or another industrial process or system).

The reheat heat exchanger 162 may also be configured to receive waste fluid from multiple waste heat sources, such as from a second waste heat source 170 that is separate from the first waste heat source 166. For instance, the second waste heat source 170 may be the same industrial process or system associated with the first waste heat source 166 and may include another waste fluid created by the same industrial process or system, and/or the second waste heat source 170 may be another industrial process or system that creates a different waste fluid. In some implementations, the reheat heat exchanger 162 may include coils that are interlaced and are fluidly separate from one another, and the waste fluid received from the first waste heat source 166 may be fluidly separate from the waste fluid received from the second waste heat source 170. That is, for example, the waste fluid from the first waste heat source 166 may be directed through a first set of coils (e.g., a first portion of the reheat heat exchanger 162), and the waste fluid from the second waste heat source 170 may be directed through a second set of coils (e.g., a second portion of the reheat heat exchanger 162) that is fluidly separate from the first set of coils. Thus, the waste fluid received from the first waste heat source 166 does not mix with the waste fluid received from the second waste heat source 170. Additionally or alternatively, the waste fluid received from the first waste heat source 166 may mix with the waste fluid received from the second waste heat source 170. Thus, the reheat heat exchanger 162 may receive a mixture or combination of waste fluids from the various waste heat sources 166, 170. In further embodiments, the HVAC system 150 may include multiple reheat heat exchangers 162 that are each configured to receive a respective waste fluid, and the dehumidified air flow 158 may be directed across each reheat heat exchanger 162 to be reheated by each of the waste fluids. In any case, the waste heat sources 166, 170 and/or associate components may be independently controllable to direct the respective waste fluids to the reheat heat exchanger 162 so as to provide the reheat heat exchanger 162 with desirable reheat capabilities.

The HVAC system 150 may also include a control system 172 configured to operate the HVAC system 150. The control system 172 may have a memory 174 and processing circuitry 176. The memory 174 may include volatile memory, such as random-access memory (RAM), and/or non-volatile memory, such as read-only memory (ROM), optical drives, hard disc drives, solid-state drives, or any other non-transitory computer-readable medium that includes instructions to operate the HVAC system 150. The processing circuitry 176 may be configured to execute such instructions, such as to adjust the amount of cooling provided by the refrigerant circuit 152 and/or the amount of reheating provided by the reheat system 160. The processing circuitry 176 may include one or more application specific integrated circuits (ASICs), one or more field programmable gate arrays (FPGAs), one or more general purpose processors, or any combination thereof.

The control system 172 may be communicatively coupled to components of the refrigerant circuit 152 and/or to components of the reheat system 160, and the control system 172 may be configured to control the refrigerant circuit 152 independently of the reheat system 160. By way of example, the control system 172 may operate the compressor 74 and/or the expansion device 78 to control a temperature of the refrigerant in the evaporator 80, thereby enabling the refrigerant to absorb a desirable amount of heat from the air flow 154 to cool and dehumidify the air flow 154. Further, the control system 172 may operate the reheat system 160 to control an amount of waste fluid delivered from the waste heat sources 166, 170 to the reheat heat exchanger 162 to control an amount of heat available in the reheat heat exchanger 162 for transfer to the dehumidified air flow 158 to reheat the dehumidified air flow 158. To this end, the HVAC system 150 may include a first pump 180 configured to direct waste fluid from the first waste heat source 166 toward the reheat heat exchanger 162 and a second pump 182 configured to direct waste fluid from the second waste heat source 170 toward the reheat heat exchanger 162. The control system 172 may be communicatively coupled to the first pump 180 and the second pump 182 in order to direct waste fluid from the first waste heat source 166 and/or from the second waste heat source 170 to provide reheating of the dehumidified air flow 158. Indeed, the control system 172 may independently control (e.g., to enable operation of or to suspend operation of) the first pump 180 and the second pump 182 in order to provide desirable reheating functionality. In certain embodiments, the first pump 180, the second pump 182, or both, may be a variable speed pump. In this way, the control system 172 may control the first pump 180 and/or the second pump 182 at particular selected speeds to direct the waste fluid from the first waste heat source 166 and/or from the second waste heat source 170 at respective flow rates to provide a target amount of reheat.

In some embodiments, the control system 172 may be communicatively coupled to sensors 178 and may control the components of the HVAC system 150 based on sensor data received from the sensors 178. For example, one or more of the sensors 178 may be disposed in the space 156, may be coupled to the refrigerant circuit 152, and/or may be coupled to the reheat system 160, and may be configured to detect or determine an operating parameter (e.g., a temperature, humidity, and/or pressure) of the air flow 154, of the space 156, of the dehumidified air flow 158, of the refrigerant, of the heated waste fluid(s), of any other suitable component, or any combination thereof, of the HVAC system 150. The control system 172 may control the amount of cooling provided by the refrigerant circuit 152 and/or the amount of reheating provided by the reheat system 160 (e.g., by controlling the first pump 180 and/or the second pump 182) based on the sensor data received from the sensors 178. Indeed, the control system 172 may determine a target amount of cooling and/or a target amount of reheating to be provided by the HVAC system 150 based on the sensor data, and the control system 172 may operate the HVAC system 150 based on the target amount of cooling and/or the target amount of reheating.

In certain embodiments, the HVAC system 150 may include a housing or an enclosure 184 that may contain the components configured to condition the air flow 154, including components of the refrigerant circuit 152, the air flow conduit 155, the reheat system 160, and/or other suitable components of the HVAC system 150. The air flow conduit 155 may direct the air flow 154 through the housing 184, such as through air flow passages, in order to be conditioned by the HVAC system 150, and then out of the housing 184 toward the space 156. Furthermore, the waste heat sources 166, 170, which may be located external to the housing 184, may direct the heated waste fluids into the housing 184 to the reheat heat exchanger 162 to exchange heat with the dehumidified air flow 158. The housing 184 may include a housing or other covering to shield the components of the HVAC system 150 from debris to protect the components of the HVAC system 150. Thus, the housing 184 may provide a structure of the HVAC system 150 and enable the HVAC system 150 to operate and condition the air flow 154.

Figure 6:
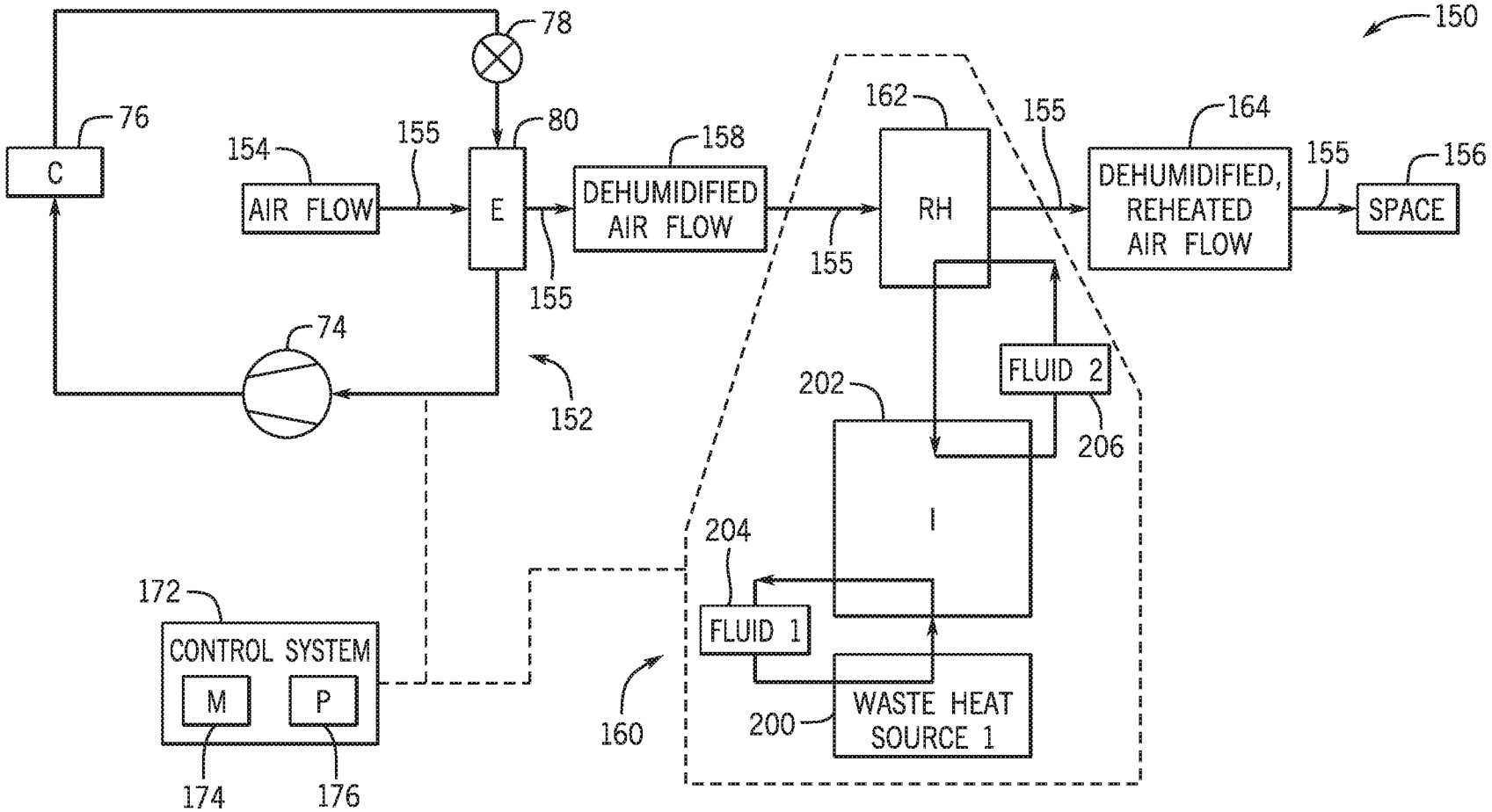
FIG. 6 is a schematic of an embodiment of an HVAC system having a reheat system configured to extract heat from a waste heat source via an intermediate heat exchanger, in accordance with an aspect of the present disclosure.

FIG. 6 is a schematic of the HVAC system 150 having the reheat system 160, which includes a waste heat source 200 and an intermediate heat exchanger 202. The intermediate heat exchanger 202 may receive a first fluid 204, which may be a heated waste fluid (e.g., a heated liquid, a heated gas), from the waste heat source 200. Additionally, the reheat system 160 may circulate a second fluid 206, such as water and/or refrigerant, through the intermediate heat exchanger 202 and the reheat heat exchanger 162. The intermediate heat exchanger 202 may place the first fluid 204 in a heat exchange relationship with the second fluid 206. As an example, the intermediate heat exchanger 202 may transfer thermal energy from the first fluid 204 to the second fluid 206, thereby heating the second fluid 206. The heated second fluid 206 may be directed to the reheat heat exchanger 162, where heat from the second fluid 206 transfers to the dehumidified air flow 158 to produce the dehumidified, reheated air flow 164. In this manner, contact between the first fluid 204 and the reheat heat exchanger 162 through which the dehumidified air flow 158 is directed is avoided. Indeed, the reheat capability (e.g., an amount of available thermal energy) provided by the second fluid 206 may be more easily controlled than that of the first fluid 204 and may therefore be used to provide a desirable amount of reheat for the dehumidified air flow 158.

In the illustrated embodiment, the second fluid 206 is circulated between the intermediate heat exchanger 202 and the reheat heat exchanger 162. Therefore, after heating the dehumidified air flow 158, the second fluid 206 may be directed to the intermediate heat exchanger 202 to be heated by the first fluid 204 and then directed from the intermediate heat exchanger 202 back to the reheat heat exchanger 162 for reuse in reheating the dehumidified air flow 158. Further, the first fluid 204 may be circulated between the waste heat source 200 and the intermediate heat exchanger 202, such that the waste heat source 200 may reuse the first fluid 204 after the first fluid 204 exchanges heat with the second fluid 206. Additionally or alternatively, the second fluid 206 may be discharged from the reheat system 160 after exchanging heat with the dehumidified air flow 158 and/or the first fluid 204 may be discharged from the reheat system 160 after exchanging heat with the second fluid 206.

Figure 7:
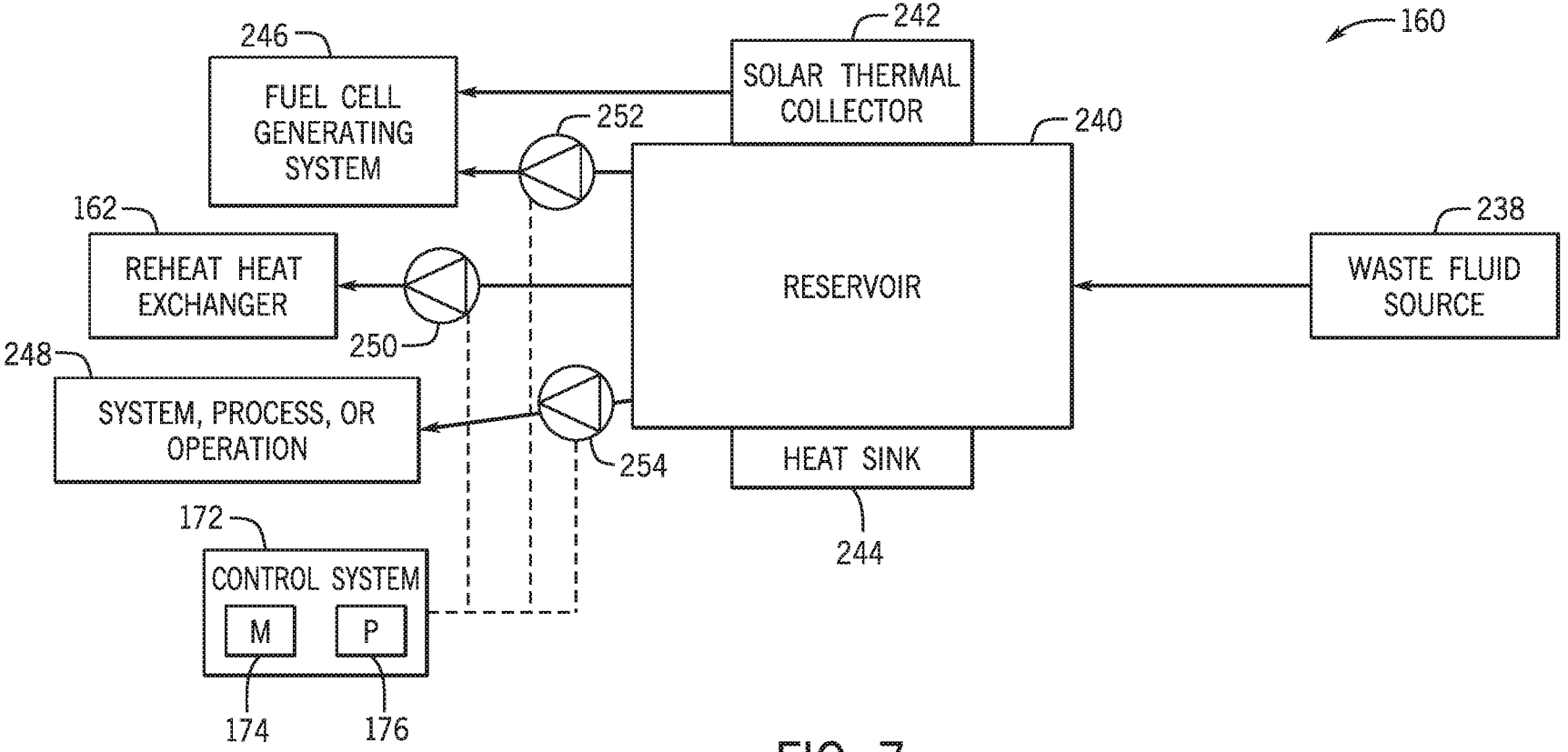
FIG. 7 is a schematic of an embodiment of a reheat system having a reservoir configured to receive waste fluid from a waste fluid source, in accordance with an aspect of the present disclosure.

FIG. 7 is a schematic of an embodiment of the reheat system 160 that includes a reservoir 240 configured to receive waste fluid from a waste fluid source 238. The waste fluid source 238 may be a part of any suitable process or system that generates waste fluid, including waste water, oil, air, steam, and the like, that may collect and accumulate within the reservoir 240. For instance, the waste fluid source 238 may include moisture removed from the air flow 154, such as via the evaporator 80. The reservoir 240 may be configured to heat the waste fluid to increase an amount of heat that is available in the waste fluid for reheating the dehumidified air flow 158. Indeed, the reservoir 240 may receive waste fluid of any temperature from the waste fluid source 238, and the waste fluid may be heated to a sufficient temperature within the reservoir 240 to enable the waste fluid to transfer heat to the dehumidified air flow 158 via the reheat heat exchanger 162.

In some embodiments, the reheat system 160 may include a solar thermal collector 242, which may convert solar energy to thermal energy. That is, the solar thermal collector 242 may generate heat from absorbing sunlight. The solar thermal collector 242 may be thermally coupled to the waste fluid in the reservoir 240 and may transfer generated thermal energy to the waste fluid, thereby heating the waste fluid in the reservoir 240. The heated waste fluid may then be directed to the reheat heat exchanger 162 to transfer heat to the dehumidified air flow 158. In additional or alternative embodiments, the reheat system 160 may include a heat sink 244 that is thermally coupled to the reservoir 240. The heat sink 244 may receive thermal energy, such as electrical heat, waste heat, or another type of heat, from other sources (e.g., generated by the waste heat source 200 of FIG. 6). The heat sink 244 may transfer the thermal energy to the waste fluid in the reservoir 240, thereby heating the waste fluid. For instance, the heat sink 244 may include a salt storage or other suitable material configured to effectively store heat and to transfer heat to the waste fluid.

In some embodiments, the reservoir 240 may be fluidly coupled to other components so as to use the waste fluid for other functions. By way of example, the reservoir 240 may be fluidly coupled to a fuel cell generating system 246. For instance, the waste fluid source 238 may supply waste water to the reservoir 240, which may direct the waste water to the fuel cell generating system 246. The fuel cell generating system 246 may also be thermally coupled to the solar thermal collector 242. As such, the fuel cell generating system 246 may use solar energy from the solar thermal collector 242 to perform electrolysis and split hydrogen molecules and oxygen molecules of the waste water. The split hydrogen and oxygen molecules may then be used to generate electrical energy via fuel cells. As such, the reheat system 160 may be used to generate electrical energy in addition to thermal energy. In additional or alternative embodiments, the reservoir 240 may be fluidly coupled to another system, process, or operation 248, such as another industrial process in which heat and/or a heated fluid is desirable. By way of example, the system, process, or operation 248 may be a furnace configured to provide heating for the space 156. In this way, the reservoir 240 may be used as a heat source for the system, process, or operation 248.

In any case, the heated waste fluid may be stored within the reservoir 240 before being discharged for other purposes. Indeed, the waste fluid received from the waste fluid source 238 may be continuously heated while being stored within the reservoir 240. The heated waste fluid may then be directed out of the reservoir 240 at a later time, such as based on a request or a demand (e.g., a demand for reheat). For this reason, the reservoir 240 may include an insulative material in order to block undesirable heat loss of the waste fluid, such as to an ambient environment, thereby maintaining the amount of thermal energy of the waste fluid stored within the reservoir 240.

The control system 172 may be configured to control discharge of heated waste fluid from the reservoir 240. For instance, the control system 172 may be communicatively coupled to a first pump 250 configured to direct heated waste fluid to the reheat heat exchanger 162, a second pump 252 configured to direct heated waste fluid to the fuel cell generating system 246, and a third pump 254 configured to direct heated waste fluid to the system, process, or operation 248. The control system 172 may control the pumps 250, 252, 254 independently of one another to control a respective flow rate of the heated waste fluid to the reheat heat exchanger 162, to the fuel cell generating system 246, and/or to the system, process, or operation 248. For example, the control system 172 may adjust the flow rate of the heated waste fluid out of the reservoir 240 based on a volume of waste fluid in the reservoir 240, a temperature of the waste fluid in the reservoir 240, a load demand of the reheat heat exchanger 162 to heat the dehumidified air flow 158, a load demand of the fuel cell generating system 246 to generate electricity, and/or a load demand of the system, process, or operation 248 to provide thermal energy.

Figure 8:
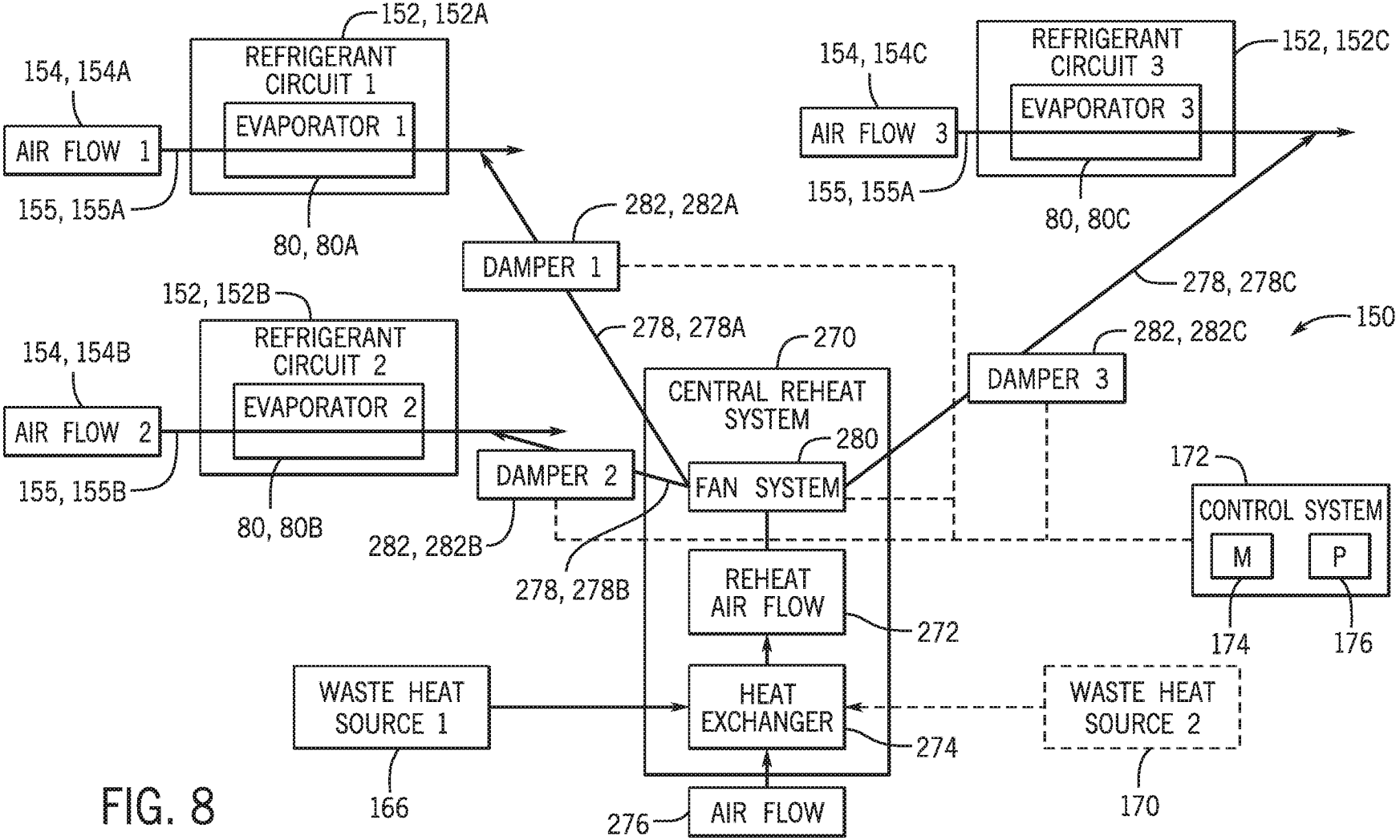
FIG. 8 is a schematic of an embodiment of an HVAC system having a central reheat system configured to reheat air flows directed across respective refrigerant circuits, in accordance with an aspect of the present disclosure.

FIG. 8 is a schematic of an embodiment of the HVAC system 150 having multiple refrigerant circuits 152 that are fluidly separate from one another, and each of the refrigerant circuits 152 may condition a respective air flow 154. For example, each refrigerant circuit 152 may include an evaporator 80 configured to cool the respective air flow 154 directed through the refrigerant circuit 152 via a respective air flow conduit 155. Although three refrigerant circuits 152 are shown in the illustrated embodiment, any suitable number of refrigerant circuits 152, including two refrigerant circuits 152 or more than three refrigerant circuits 152, may be included in additional or alternative embodiments.

The HVAC system 150 may have a central reheat system 270 configured to reheat the respective air flows 154. As an example, the central reheat system 270 may include a housing or enclosure that is separate from the respective housings or enclosures of the refrigerant circuits 152. The central reheat system 270 may be fluidly coupled to each of the air flow conduits 155 and may be configured to deliver a reheat air flow 272 to exchange heat with or to combine with one of the air flows 154. In the illustrated embodiment, the central reheat system 270 is configured to discharge the reheat air flow 272 for mixture with each of the air flows 154. For instance, the central reheat system 270 may include a heat exchanger 274 configured to heat an air flow 276 received by the central reheat system 270 to produce the reheat air flow 272. As an example, the heat exchanger 274 may extract heat from a waste heat source, such as from the first waste heat source 166 and/or from the second waste heat source 170. The central reheat system 270 further includes respective reheat air flow conduits 278 fluidly coupling the central reheat system 270 to the air flow conduits 155. A fan system 280 of the reheat air flow conduits 278 may direct the reheat air flow 272 through the reheat air flow conduits 278 to flow into the air flow conduits 155 downstream of the evaporators 80 relative to a flow direction of the air flows 154 through the respective air flow conduits 155. In this manner, the reheat air flow 272 reheats the respective air flows 154 by mixing the reheat air flow 272 with the respective air flows 154.

The flow rate of the reheat air flow 272 to each of the air flow conduits 155 may be independently controllable. For instance, each reheat air flow conduit 278 may have a damper 282 configured to enable flow of the reheat air flow 272 from the central reheat system 270 to one of the air flow conduits 155. The control system 172 may control a size of a respective opening of each damper 282 to control the flow rate of the reheat air flow 272 directed through each of the reheat air flow conduits 278 to the air flow conduits 155. Thus, the control system 172 may operate the central reheat system 270 to provide a different amount of reheat to the various air flows 154. Additionally or alternatively, the fan system 280 may include multiple fans configured to direct respective amounts of the reheat air flow 272 to each of the air flow conduits 155. That is, each fan of the fan system 280 may direct a portion of the reheat air flow 272 to one of the air flow conduits 155. The fans may be variable speed fans, and the control system 172 may be configured to independently adjust a respective operating speed of each of the fans to direct the reheat air flow 272 at various flow rates through the respective reheat air flow conduits 278 to the air flow conduits 155 so as to individually control the amount of reheat provided to each of the air flows 154.

Figure 9:
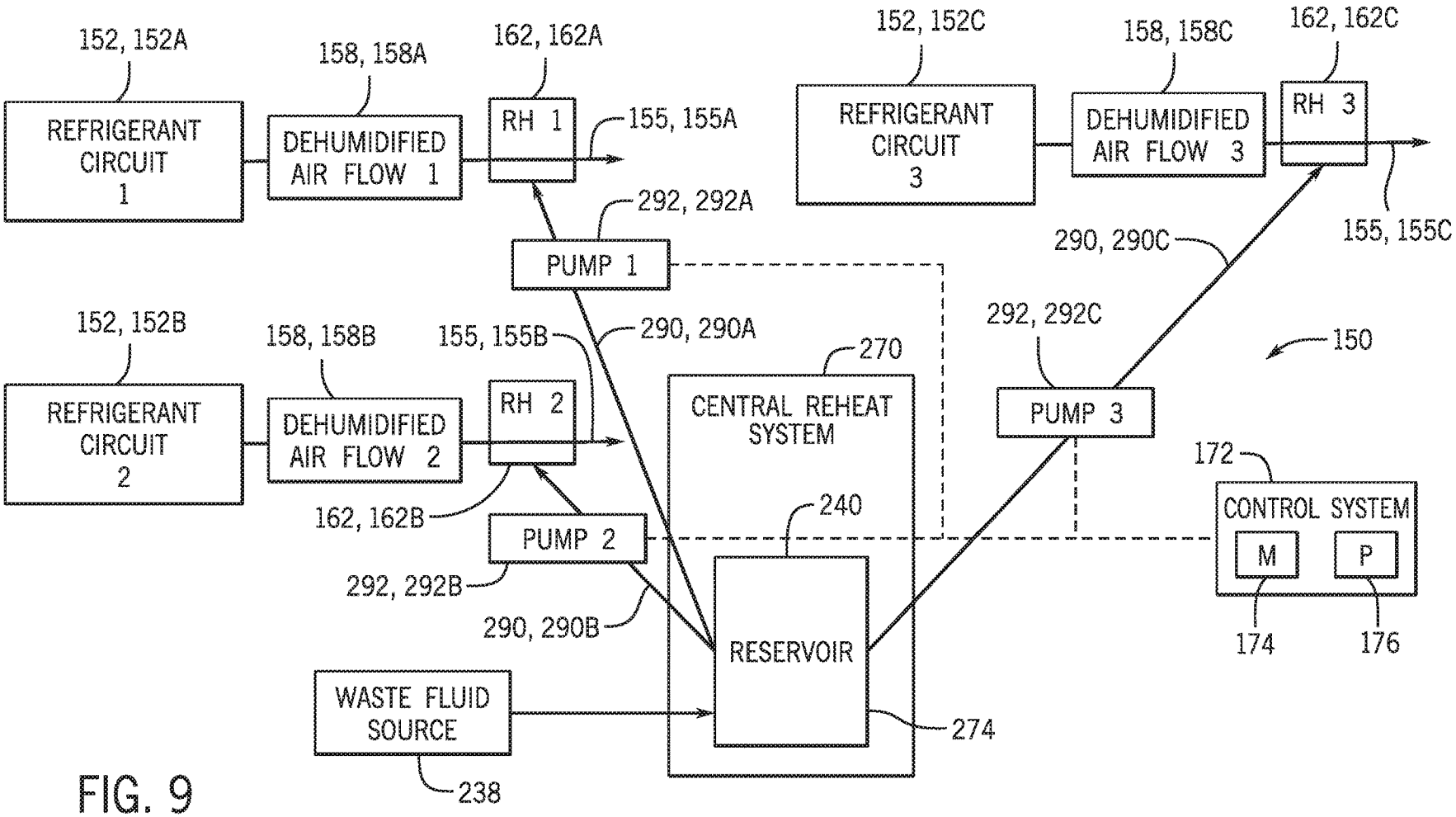
FIG. 9 is a schematic of an embodiment of an HVAC system having a central reheat system configured to direct reheat fluid from a reservoir to multiple refrigerant circuits, in accordance with an aspect of the present disclosure.

FIG. 9 is a schematic of an embodiment of the HVAC system 150 having the central reheat system 270, which is configured to direct reheat fluid (e.g., waste fluid) from the reservoir 240 to condition any of the dehumidified air flows 158 (e.g., dehumidified air flows 158A, 158B, 158C) downstream of the refrigerant circuits 152 (e.g., refrigerant circuits 152A, 152B, 152C). Each of the dehumidified air flows 158 may be placed in a heat exchange relationship with the reheat fluid in a respective reheat heat exchanger 162 (e.g., reheat heat exchangers 162A, 162B, 162C). In the illustrated example, the central reheat system 270 includes the reservoir 240, which may receive waste fluid from the waste fluid source 238 and may heat the waste fluid collected within the reservoir 240 (e.g., via the solar thermal collector 242 and/or the heat sink 244). The central reheat system 270 may be fluidly coupled to each of the reheat heat exchangers 162 via reheat fluid conduits 290. Therefore, heated waste fluid may be directed from the reservoir 240 to any of the reheat heat exchangers 162 via the reheat fluid conduits 290 to reheat the respective dehumidified air flow 158 directed across the reheat heat exchanger 162 (e.g., to produce the dehumidified, reheated air flow 164). For example, respective pumps 292 may operate to control the heated waste fluid directed to the reheat heat exchangers 162.

In some embodiments, the control system 172 may independently control each of the pumps 292. As an example, the control system 172 may independently enable or suspend operation of the pumps 292 to enable or block flow of heated waste fluid to the respective reheat heat exchangers 162. As another example, each of the pumps 292 may be variable speed pumps, and the control system 172 may control a particular speed at which each of the pumps 292 may operate to control the flow rate of heated waste fluid through each of the reheat heat exchangers 162. In this manner, the control system 172 may operate the central reheat system 270 to provide a different amount of reheat to the dehumidified air flows 158.

Figure 10:
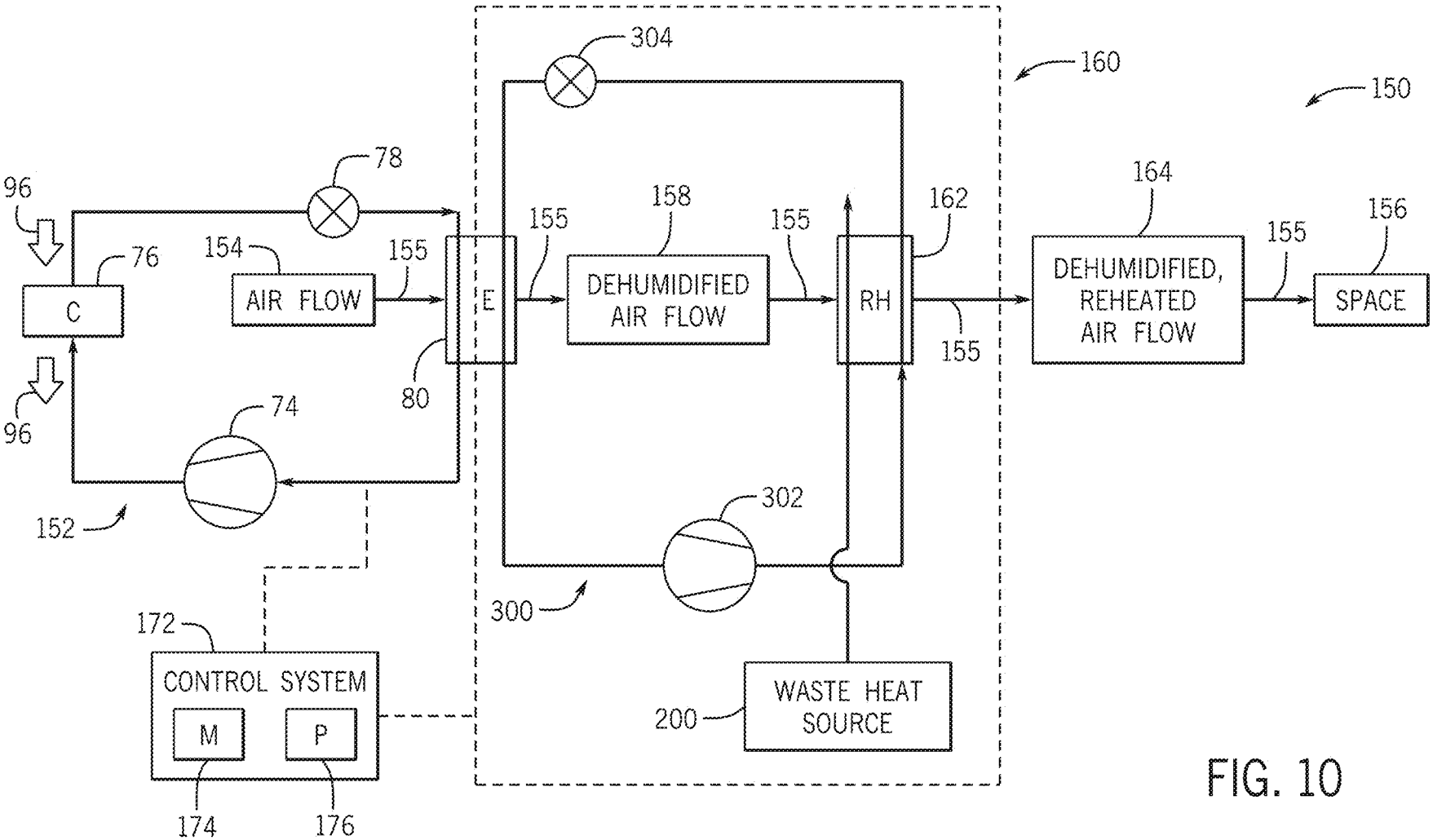
FIG. 10 is a schematic of an embodiment of an HVAC system having a first refrigerant circuit configured to cool an air flow and a second refrigerant circuit configured to reheat the air flow, in accordance with an aspect of the present disclosure.

FIG. 10 is a schematic of an embodiment of the HVAC system 150 having the reheat system 160 that is fluidly separate from the refrigerant circuit 152. The reheat system 160 in the illustrated embodiment includes a reheat fluid circuit 300. For example, the reheat fluid circuit 300 may be configured to circulate an additional refrigerant and may include an additional compressor 302 configured to pressurize and heat the additional refrigerant. The reheat fluid circuit 300 may further include the reheat heat exchanger 162 configured to receive the heated additional refrigerant from the additional compressor 302, and/or the reheat fluid circuit 300 may include an additional expansion device 304 configured to depressurize and cool the additional refrigerant.

In certain embodiments, the reheat fluid circuit 300 may extend through the evaporator 80 of the refrigerant circuit 152. For example, the evaporator 80 may include interlaced coils that are fluidly separate from another, where cooled refrigerant of the refrigerant circuit 152 may be directed through a first set of coils of the evaporator 80, and cooled additional refrigerant of the reheat fluid circuit 300 may be directed through a second set of coils of the evaporator 80 fluidly separate from the first set of coils. The air flow 154 may therefore exchange heat with the refrigerant and with the additional refrigerant when directed across the evaporator 80. In additional or alternative embodiments, the reheat fluid circuit 300 may include an additional evaporator separate from the evaporator 80 to receive the cooled additional refrigerant, and the air flow 154 may be directed across the evaporator 80 of the refrigerant circuit 152 to exchange heat with the cooled refrigerant and across the additional evaporator of the reheat fluid circuit 300 to exchange heat with the cooled additional refrigerant. In further embodiments, the reheat fluid circuit 300 may include an additional evaporator that does not receive the air flow 154 (e.g., is not disposed within the air flow conduit 155). That is, the air flow 154 may be directed across the evaporator 80 of the refrigerant circuit 152 and may bypass the additional evaporator of the reheat fluid circuit 300 to avoid further cooling of the air flow 154. In this way, the reheat fluid circuit 300 may operate to reheat the dehumidified air flow 158 without providing cooling of the air flow 154.

The control system 172 may be configured to operate the refrigerant circuit 152 independently from the reheat fluid circuit 300. As an example, the additional compressor 302 may be a variable speed or a multi stage compressor, and the control system 172 may be configured to change the operation of the additional compressor 302 to adjust the amount of pressurization of the additional refrigerant, thereby changing the temperature of the additional refrigerant directed through the reheat heat exchanger 162, without adjusting operation of any components (e.g., the compressor 74) of the refrigerant circuit 152. In this manner, the control system 172 may control the reheat fluid circuit 300 to adjust the amount of reheat provided to the dehumidified air flow 158 without changing the amount of cooling provided to the air flow 154 by the refrigerant circuit 152. For instance, the control system 172 may operate the refrigerant circuit 152 to dehumidify the air flow 154 to a target humidity, and the control system 172 may operate the additional compressor 302 of the additional refrigerant circuit 300 to reheat the dehumidified air flow 158 to a target temperature.

The reheat system 160 may also be configured to extract heat from the waste heat source 200. That is, the reheat heat exchanger 162 of the reheat system 160 may be configured to use thermal energy from the waste heat source 200 in addition to thermal energy from the additional refrigerant in order to reheat the dehumidified air flow 158. For instance, the reheat heat exchanger 162 may have fluidly separate coils, the additional refrigerant may be directed through a first coil of the reheat heat exchanger 162, and reheat fluid having thermal energy from the waste heat source 200 may be directed through a second coil of the reheat heat exchanger 162. Thus, the dehumidified air flow 158 may be placed in a first heat exchange relationship with the additional refrigerant of the reheat fluid circuit 300 to heat the dehumidified air flow 158, and the dehumidified air flow 158 may also be placed in a second heat exchange relationship with the reheat fluid to further heat the dehumidified air flow 158. Additionally or alternatively, the reheat heat exchanger 162 may transfer heat from the reheat fluid of the waste heat source 200 to the additional refrigerant of the reheat fluid circuit 300, thereby providing supplemental heating of the additional refrigerant and enabling the additional refrigerant to provide a greater amount of reheat.

In some embodiments, heat from the waste heat source 200 may be selectively extracted for use in the reheat heat exchanger 162. For instance, the control system 172 may monitor an amount of available heat that can be provided by the waste heat source 200 (e.g., a temperature of the reheat fluid of the waste heat source 200), and the control system 172 may utilize heat from the waste heat source 200 to reheat the dehumidified air flow 158 based on the amount of available heat (e.g., based on the temperature of the reheat fluid exceeding a threshold temperature). Indeed, the control system 172 may enable or block use of the waste heat source 200 for reheating to ensure that the reheat heat exchanger 162 is operating efficiently to reheat the dehumidified air flow 158.

FIG. 11 is an embodiment of the HVAC system 150 that includes a first refrigerant circuit 330, a second refrigerant circuit 332, and the reheat fluid circuit 300. The first refrigerant circuit 330 and the second refrigerant circuit 332 may each be configured to cool the air flow 154. For instance, the first refrigerant circuit 330 includes a first compressor 334 configured to pressurize a first refrigerant and direct the pressurized first refrigerant to a first condenser 336 configured to cool the first refrigerant. The first refrigerant circuit 330 may also include a first expansion device 338, which may depressurize the first refrigerant cooled by the first condenser 336, and a first evaporator 340 configured to place the first refrigerant in a first heat exchange relationship with the air flow 154 to cool the air flow 154. Furthermore, the second refrigerant circuit 332 includes a second compressor 342 configured to pressurize a second refrigerant and direct the pressurized second refrigerant to a second condenser 344, which cools the second refrigerant. The second refrigerant circuit 332 may include a second expansion device 346, which may depressurize the second refrigerant cooled by the second condenser 344, and a second evaporator 348 configured to place the second refrigerant in a second heat exchange relationship with the air flow 154 to cool the air flow 154. In this manner, the first refrigerant circuit 330 may be operated to provide cooling of the air flow 154, and the second refrigerant circuit 332 may be operated to provide supplemental cooling of the air flow 154.

The reheat fluid circuit 300, which uses the reheat heat exchanger 162 to reheat the dehumidified air flow 158, may be fluidly separate from the first refrigerant circuit 330. However, the reheat fluid circuit 300 may be fluidly coupled to the second refrigerant circuit 332. In other words, the second refrigerant may transfer between the second refrigerant circuit 332 and the reheat fluid circuit 300. For example, the HVAC system 150 may include an intermediate conduit 350 configured to enable flow of the second refrigerant between the second refrigerant circuit 332 and the reheat fluid circuit 300. In certain embodiments, the intermediate conduit 350 may fluidly couple a high pressure section of the second refrigerant circuit 332, such as a compressor discharge section of the second refrigerant circuit 332, with another high pressure section of the reheat fluid circuit 300, such as another compressor discharge section of the reheat fluid circuit 300. As such, refrigerant pressurized by the second compressor 342 of the second refrigerant circuit 332 may flow toward the reheat heat exchanger 162 of the reheat fluid circuit 300 via the intermediate conduit 350, or refrigerant pressurized by the additional compressor 302 of the reheat fluid circuit 300 may flow toward the second condenser 344 of the second refrigerant circuit 332 via the intermediate conduit 350. In additional or alternative embodiments, the intermediate conduit 350 may fluidly couple any suitable section of the second refrigerant circuit 332 with any suitable section of the reheat fluid circuit 300. In further embodiments, the HVAC system 150 may include multiple intermediate conduits 350, such as a first intermediate conduit configured to enable flow of refrigerant from the reheat fluid circuit 300 to the second refrigerant circuit 332 and a separate, second intermediate conduit configured to enable flow of refrigerant from the second refrigerant circuit 332 to the reheat fluid circuit 300.

The intermediate conduit 350 may also include a valve 352 configured to enable or block refrigerant flow between the second refrigerant circuit 332 and the reheat fluid circuit 300. The control system 172 may control the valve 352 to control an amount of the first refrigerant in the first refrigerant circuit 330, an amount of the second refrigerant in the second refrigerant circuit 332, or both, based on an operating mode of the HVAC system 150. For example, in a first mode, which may be a cooling mode in which reheat is not desirable, the first refrigerant circuit 330 and the second refrigerant circuit 332 may be in operation, and the reheat fluid circuit 300 may not be in operation. Thus, the control system 172 may open the valve 352 and operate the additional compressor 302 of the reheat fluid circuit 300 to direct substantially all of the second refrigerant from the reheat fluid circuit 300 to the second refrigerant circuit 332 based on operation in the first mode. In a second mode, which may be a reheating mode, the first refrigerant circuit 330 and the reheat fluid circuit 300 may be in operation, and the second refrigerant circuit 332 may not be in operation. Thus, the control system 172 may open the valve 352 and operate the second compressor 342 of the second refrigerant circuit 332 to direct the substantially all of the second refrigerant from the second refrigerant circuit 332 to the reheat fluid circuit 300 based on operation in the second mode. In a third mode, which may be a modulating mode, all circuits 300, 330, 332 may be in operation. As such, the control system 172 may open the valve 352 to balance the amount of the second refrigerant in the first refrigerant circuit 330 and the amount of the second refrigerant in the second refrigerant circuit 332 based on operation in the third mode. That is, the control system 172 may enable some of the second refrigerant to circulate through the second refrigerant circuit 332 and a remainder of the second refrigerant to circulate through the reheat fluid circuit 300. Indeed, the control system 172 may control the amount of the second refrigerant in the first refrigerant circuit 330 and in the second refrigerant circuit 332 based on a desirable amount of cooling and/or reheating of the air flow 154.

In the illustrated embodiment, the reheat fluid circuit 300 includes a third evaporator 354 that may heat the second refrigerant without placing the second refrigerant in a heat exchange relationship with the air flow 154. In alternative embodiments, the air flow 154 may be directed through the third evaporator 354 (e.g., from the second evaporator 348) to cool the air flow 154 via the second refrigerant. For instance, the first evaporator 340, the second evaporator 348, and the third evaporator 354 may each be separate coils of a single evaporator having interlaced coils.

Furthermore, the illustrated HVAC system 150 includes the waste heat source 200 configured to supply heat for reheating purposes to the reheat heat exchanger 162. Indeed, the waste heat source 200 may provide reheat in addition to or as an alternative to the reheat provided by the refrigerant circulated through the reheat fluid circuit 300. The control system 172 may operate the reheat fluid circuit 300 to utilize waste fluid from waste heat source 200 based on a determination regarding whether the waste fluid from the waste heat source 200 may enable the reheat heat exchanger 162 to efficiently reheat the dehumidified air flow 158 (e.g., in the second mode and/or in the third mode of the HVAC system 150). As an example, the control system 172 may operate the reheat fluid circuit 300 to utilize waste fluid from the waste heat source 200 as well as the refrigerant within the reheat fluid circuit 300 to provide sufficient reheating of the dehumidified air flow 158. As another example, the control system 172 may operate the reheat fluid circuit 300 to utilize the waste fluid to provide reheat and suspend operation of the additional compressor 302 of the reheat fluid circuit 300 in response to a determination that the reheat fluid circuit 300 operates more efficiently utilizing the waste fluid from the waste heat source 200 (e.g., instead of utilizing refrigerant) to provide desired reheating of the dehumidified air flow 158 (e.g., based on a temperature of waste fluid from the waste heat source 200 being above a threshold temperature). As a further example, the control system 172 may operate the reheat fluid circuit 300 utilizing the refrigerant instead of waste fluid from the waste heat source 200 to provide reheat in response to a determination that the amount of heat provided by the waste heat source 200 does not sufficiently or efficiently provide reheating of the dehumidified air flow 158 (e.g., based on a temperature of waste fluid from the waste heat source 200 being below a threshold temperature).

FIG. 12 is a schematic of an embodiment of the HVAC system 150 having the reheat fluid circuit 300, which may provide reheating and/or cooling capabilities via a refrigerant. The HVAC system 150 may also include the refrigerant circuit 152 configured to cool the air flow 154. As an example, the refrigerant circuit 152 may include a first compressor 370, a first condenser 372, a first expansion device 374, and a first evaporator 376. Furthermore, the reheat fluid circuit 300 may include the reheat heat exchanger 162, a second compressor 378, a second condenser 380, a second expansion device 382, and/or a second evaporator 384. In some embodiments, the first evaporator 376 and the second evaporator 384 may be different coils, such as interlaced coils, that are fluidly separate within the same evaporator housing or case. In additional or alternative embodiments, the first evaporator 376 and the second evaporator 384 may be separate evaporators that may be located within different housings or sections, such as respective housings or sections for the refrigerant circuit 152 and the reheat fluid circuit 300. The reheat fluid circuit 300 may also include a first valve (e.g., a three-way valve) 386 configured to direct pressurized refrigerant from the second compressor 378 to the reheat heat exchanger 162 and/or to the second condenser 380.

In a first mode, which may be a cooling mode, of the HVAC system 150, the control system 172 may be configured to operate the reheat fluid circuit 300 to provide cooling functionality and no reheating functionality. By way of example, the control system 172 may position the first valve 386 to enable refrigerant flow from the second compressor 378 to the second condenser 380 and block refrigerant flow from the second compressor 378 to the reheat heat exchanger 162. The second condenser 380 therefore cools the refrigerant and directs the cooled refrigerant to the second expansion device 382 and to the second evaporator 384 to cool the air flow 154, and the reheat heat exchanger 162 does not receive a substantial amount of the refrigerant. Thus, in the first mode, the reheat heat exchanger 162 does not reheat the dehumidified air flow 158, and the air flow 154 may be cooled by the first evaporator 376 of the refrigerant circuit 152 and further cooled by the second evaporator 384 of the reheat fluid circuit 300 without being reheated by the reheat heat exchanger 162. In certain implementations, the reheat fluid circuit 300 may include a first check valve 388 to block refrigerant flow from the second condenser 380 to the reheat heat exchanger 162, further blocking refrigerant flow through the reheat heat exchanger 162 in the first mode.

In a second mode, which may be a reheating mode, the control system 172 may be configured to operate the reheat fluid circuit 300 to provide both cooling functionality and reheating functionality. To this end, the control system 172 may position the first valve 386 to enable refrigerant flow from the second compressor 378 to the reheat heat exchanger 162 and block refrigerant flow from the second compressor 378 to the second condenser 380. Thus, the reheat heat exchanger 162 places the refrigerant from the second compressor 378 in a heat exchange relationship with the dehumidified air flow 158 to reheat the dehumidified air flow 158 and to cool the refrigerant. The cooled refrigerant may then be directed toward the second evaporator 384 to cool the air flow 154. Thus, in the second mode, the air flow 154 may be cooled by both the first evaporator 376 and the second evaporator 384, and the air flow 154 may then be reheated by the reheat heat exchanger 162 to become the dehumidified, reheated air flow 164. In this way, the reheat fluid circuit 300 provides both reheating and cooling functionalities. In some embodiments, the reheat fluid circuit 300 may include a second check valve 390 configured to block refrigerant flow from the reheat heat exchanger 162 to the second condenser 380. Thus, refrigerant flow through the second condenser 380 is restricted in the second mode.

In a third mode, which may be a modulating reheating mode, the control system 172 may be configured to position the first valve 386 (e.g., a modulating valve) to enable refrigerant to flow from the second compressor 378 to both the reheat heat exchanger 162 and the second condenser 380. For example, it may be desirable to enable some reheating functionality of the reheat heat exchanger 162, but less reheating as compared to that in the second mode. To this end, a portion of the refrigerant pressurized by the second compressor 378 is directed to the reheat heat exchanger 162 to provide some reheating functionality. A remaining portion of the refrigerant pressurized by the second compressor 378 may be directed to the second condenser 380 to cool the refrigerant without reheating the dehumidified air flow 158.

In further embodiments, the HVAC system 150 may include a heat exchanger 392 configured to place the refrigerant of the reheat fluid circuit 300 in a heat exchange relationship with the refrigerant of the refrigerant circuit 152. As an example, the reheat fluid circuit 300 may include a second valve (e.g., a four-way valve) 394 configured to direct refrigerant cooled by the second condenser 380 and/or refrigerant cooled within the reheat heat exchanger 162 to a third expansion device 396, which depressurizes the refrigerant and directs the cooled refrigerant to the heat exchanger 392. The heat exchanger 392 may enable heat to transfer from the refrigerant of the refrigerant circuit 152 to the refrigerant of the reheat fluid circuit 300, thereby providing supplemental cooling of the refrigerant of the refrigerant circuit 152 and increasing a cooling capacity of the first evaporator 376. The refrigerant of the reheat fluid circuit 300 may then be directed from the heat exchanger 392 directly to the second compressor 378, thereby bypassing the second expansion device 382 and the second evaporator 384. In this manner, the refrigerant of the reheat fluid circuit 300 directed through the heat exchanger 392 is not used to cool the air flow 154 via the second evaporator 384. It should be noted that the second valve 394 may also direct refrigerant from the second condenser 380 and/or from the reheat heat exchanger 162 through the heat exchanger 392. In other words, the refrigerant directed through the second condenser 380 and/or through the dehumidified air flow 158 may be used to cool the air flow 154 directly via the second evaporator 384 and/or to cool the refrigerant of the refrigerant circuit 152 via the heat exchanger 392. Indeed, the second valve 394 may be a modulating valve and may be operated to direct the refrigerant from the second condenser 380 and from the reheat heat exchanger 162 at any suitable flow rates relative to one another to cool the refrigerant of the refrigerant circuit 152 and to cool the air flow 154 directed across the second evaporator 384.

In additional or alternative embodiments, the reheat fluid circuit 300 may include other components to enable the refrigerant to flow in other manners through the reheat fluid circuit 300. As an example, the reheat fluid circuit 300 may include separate three-way valves configured to direct refrigerant from the reheat heat exchanger 162 to the heat exchanger 392 and from the second condenser 380 to the heat exchanger 392. As another example, the reheat fluid circuit 300 may be configured to direct the refrigerant through the heat exchanger 392 and then to the second evaporator 384 before returning to the second compressor 378. In this manner, the refrigerant of the reheat fluid circuit 300 may be configured to cool the refrigerant of the refrigerant circuit 152 and the air flow 154 via the second evaporator 384 in a series flow. In any case, the control system 172 may operate the reheat fluid circuit 300 to direct refrigerant in various manners to condition the air flow 154 desirably.

Moreover, the reheat heat exchanger 162 may further be configured to use thermal energy from the waste heat source 200. For example, the reheat heat exchanger 162 may receive heated fluid from the waste heat source 200 or otherwise extract heat from the waste heat source 200 to reheat the dehumidified air flow 158. Indeed, the waste heat source 200 may supplement the reheating capabilities provided by the refrigerant directed from the second compressor 378, and the control system 172 may operate the reheat fluid circuit 300 to utilize waste fluid from the waste heat source 200 to further reheat the dehumidified air flow 158.

The present disclosure may provide one or more technical effects useful in the operation of an HVAC system. For example, the HVAC system may include a refrigerant circuit configured to circulate a refrigerant to cool an air flow and dehumidify the air flow via cooled refrigerant, and the HVAC system may include a reheat system configured to reheat the air flow to a comfortable or desirable temperature level. In certain embodiments, the reheat system may be configured to extract heat from a waste heat source, such as from an industrial process or system that generates heat as a byproduct, for use in reheating the air flow. In additional or alternative embodiments, the reheat system may include an additional refrigerant circuit configured to circulate an additional refrigerant, and the additional refrigerant circuit may heat the refrigerant and use heated refrigerant to reheat the air flow. In any case, the refrigerant circuit and the reheat system may be fluidly separate and may be independently controllable. Thus, the refrigerant circuit may provide an amount of cooling without affecting an amount of reheating provided by the reheat system, and the reheat system may provide an amount of reheating without affecting an amount of cooling provided by the refrigerant circuit. As a result, the condition of the air flow, including a humidity and/or a temperature of the air flow, may be acutely controlled. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a refrigerant circuit configured to circulate a refrigerant to condition a first air flow within an air flow conduit in a reheating mode of the HVAC system;

an evaporator of the refrigerant circuit, wherein the evaporator is configured to place the refrigerant in a first heat exchange relationship with the first air flow to cool the first air flow in the reheating mode;

a reheat heat exchanger fluidly separate from the refrigerant circuit, wherein the reheat heat exchanger is configured to place a waste fluid in a second heat exchange relationship with the first air flow to reheat the first air flow cooled by the evaporator in the reheating mode;

a condenser of the refrigerant circuit, wherein the condenser is configured to place the refrigerant in a third heat exchange relationship with a second air flow to cool the refrigerant in the reheating mode; and a reservoir fluidly coupled to the reheat heat exchanger and configured to store the waste fluid for supply to the reheat heat exchanger.

2. The HVAC system of claim 1, wherein the waste fluid comprises condensation formed during operation of the evaporator, a fluid produced by an industrial process, or both.

3. The HVAC system of claim 1, wherein the HVAC system comprises a solar thermal collector configured to convert solar energy into thermal energy and to transfer the thermal energy to the waste fluid stored in the reservoir, a heat sink configured to transfer thermal energy from an industrial process to the waste fluid stored in the reservoir, or both.

4. The HVAC system of claim 1, wherein the refrigerant circuit is a first refrigerant circuit, the refrigerant is a first refrigerant, the air flow conduit is a first air flow conduit, the reheat heat exchanger is a first reheat heat exchanger, the HVAC system comprises a second refrigerant circuit configured to circulate a second refrigerant to condition a third air flow within a second air flow conduit and a second reheat heat exchanger that is fluidly separate from the second refrigerant circuit and from the first refrigerant circuit, and the second reheat heat exchanger is configured to place the waste fluid in a fourth heat exchange relationship with the third air flow to reheat the third air flow conditioned by the second refrigerant circuit.

5. The HVAC system of claim 4, comprising a first pump configured to direct the waste fluid from the reservoir to the first reheat heat exchanger, a second pump configured to direct the waste fluid from the reservoir to the second reheat heat exchanger, and a control system communicatively coupled to the first pump and to the second pump, wherein the control system is configured to operate the first pump independently of the second pump to reheat the first air flow, the third air flow, or both.

6. The HVAC system of claim 1, wherein the reservoir is fluidly coupled to a fuel cell generating system configured to generate electrical energy via the waste fluid directed from the reservoir to the fuel cell generating system.

* * * * *